US010895024B2

(12) United States Patent
Evenepoel et al.

(10) Patent No.: US 10,895,024 B2
(45) Date of Patent: Jan. 19, 2021

(54) TENSION COMPENSATOR

(71) Applicant: Gilbos N.V., Aalst (BE)

(72) Inventors: Hans Evenepoel, Oudegem (BE); Erik Gilbos, Dikkelvenne (BE); Sigurn Vandenbrande, Dentergem (BE); Björn Quidé, Moorsel (BE)

(73) Assignee: Gilbos N.V., Aalst (BE)

( * ) Notice: Subject to any disclaimer, the term of this patent is extended or adjusted under 35 U.S.C. 154(b) by 335 days.

(21) Appl. No.: 15/774,636

(22) PCT Filed: Nov. 9, 2016

(86) PCT No.: PCT/IB2016/001770
§ 371 (c)(1),
(2) Date: May 9, 2018

(87) PCT Pub. No.: WO2017/081544
PCT Pub. Date: May 18, 2017

(65) Prior Publication Data

US 2020/0263329 A1 Aug. 20, 2020

(30) Foreign Application Priority Data

Nov. 10, 2015 (BE) ..... 2015/5735

(51) Int. Cl.
*D02G 3/28* (2006.01)

(52) U.S. Cl.
CPC ..... *D02G 3/286* (2013.01)

(58) Field of Classification Search
CPC ..... D02G 3/286
USPC ..... 57/204, 293
See application file for complete search history.

(56) References Cited

U.S. PATENT DOCUMENTS

| | | | | |
|---|---|---|---|---|
| 3,225,533 | A | 12/1965 | Henshaw | |
| 3,306,023 | A | 2/1967 | Henshaw | |
| 3,353,344 | A | 11/1967 | Clendening | |
| 3,434,275 | A | 3/1969 | Backer | |
| 3,443,370 | A | 5/1969 | Walls | |
| 3,507,108 | A | 4/1970 | Yoshimura | |
| 3,717,988 | A | 2/1973 | Walls | |
| RE27,717 | E | 8/1973 | Breen | |
| 3,775,955 | A | 12/1973 | Shah | |
| 3,898,719 | A | 8/1975 | Lloyd | |
| 3,940,917 | A | 3/1976 | Strachan | |
| 4,246,750 | A * | 1/1981 | Norris | D02G 3/286 57/204 |

(Continued)

FOREIGN PATENT DOCUMENTS

WO 2012059560 A1 5/2012

*Primary Examiner* — Shaun R Hurley
(74) *Attorney, Agent, or Firm* — James Creighton Wray

(57) ABSTRACT

The current invention concerns an improved system and method for the manufacturing of alternating S/Z cabled yarn 16) or connected alternating S/Z twist plied yarns, in which tension decrease or increase is avoided by variable longitudinal contraction when twist plying or overtwisting yarns. This longitudinal contraction Is very difficult to predict and leads to tension in the yarns, which can affect the quality. This tension can also be reproduced in the installations. This invention tries to improve this by providing a tension compensator (24) that (partially) compensates the tensions and forces between different, subsequent forces for processing yarns.

15 Claims, 3 Drawing Sheets

(56) References Cited

U.S. PATENT DOCUMENTS

| | | | | | |
|---|---|---|---|---|---|
| 4,873,821 | A * | 10/1989 | Hallam | D02G 3/286 | 57/293 |
| 5,012,636 | A * | 5/1991 | Hallam | D02G 3/286 | 57/204 |
| 5,134,840 | A * | 8/1992 | Niederer | D02G 1/162 | 57/204 |
| 5,179,827 | A * | 1/1993 | Tinsley | D02G 3/286 | 57/204 |
| 5,228,282 | A * | 7/1993 | Tinsley | D02G 3/286 | 57/293 |
| 5,577,376 | A * | 11/1996 | McAllister | D02G 3/286 | 57/204 |
| 5,644,909 | A | 7/1997 | Knoff | | |
| 6,536,700 | B2 * | 3/2003 | Watson | B65H 55/04 | 226/44 |
| 8,443,581 | B2 * | 5/2013 | Koshimizu | B65H 51/10 | 57/293 |
| 2006/0147166 | A1 * | 7/2006 | Roba | B65H 49/02 | 385/123 |
| 2013/0205741 | A1 * | 8/2013 | Gilbos | D02G 3/286 | |
| 2016/0348289 | A1 * | 12/2016 | Shah | D02G 3/286 | |
| 2018/0088294 | A1 * | 3/2018 | Testu | G02B 6/4413 | |

* cited by examiner

TENSION COMPENSATOR

TECHNICAL DOMAIN

The invention relates to an improved installation for imposing an alternating S/Z torsion on a yarn and the following methods and systems for manufacturing the improved finished products such as alternating S/Z twist plied and/or cabled yarn and/or connected alternating S/Z twist plied yarn.

STATE OF THE ART

The current invention relates to cabled yarns or connected plied yarns and methods and systems or installations for the manufacture thereof. In order to cable or to connect yarns, a two-step method is used. In a first step, a group of at least to yarns is twisted, which results in a twist plied yarn. In a second step, the twist plied yarn is (twist) plied again with one or more other yarns, preferably also plied yarns, which results in a cabled yarn or connected yarns.

It is possible to produce a connected plied or cabled yarn by providing several yarns with a so-called "alternating S/Z twist" (creating alternatingly oriented zones of twist), bringing the twisted yarns together, partially connecting the different yarns into nodes, after which the different yarns twist into each other while unwinding under the influence of the torsion of the alternating S/Z twist. In this way, the twist plying or cabling of the yarn is obtained naturally, hence the term "self-twist", where the yarn has a twist at both sides of the nodes with opposite sense of rotation. The nodes are zones with twist reversal and they have none to zero net twist. When cabling yarns in a two-step process, in a first step a group of twisted yarns is juxtaposed in a longitudinal direction and connected into twist nodes, e.g. in which a twist node is created every 1 to 5 meters, which after untwisting results in winding yarns, i.e. a twist plied yarn. In a second step, the plied yarn is re-twisted and brought together with other twisted yarns, preferably also plied yarns. In this second step, the gathered yarns are connected into cabling nodes, where after untwisting a cabled yarn is obtained. Here, it is advantageous that the cabling nodes are applied as precisely as possible near the (twist) plying nodes, in order to reduce the number of visible nodes. As said, nodes are zones with none to very little net twist, which is a visible deviation in the resulting cabled or connected plied yarn, i.e. the quantity and the length of the nodes must be limited as much as possible in order to increase the quality of the connected twined or cabled yarns.

Methods related to the manufacturing of plied or cabled yarns have already been described conceptually in the following documents: "Self-Twist Yarn", D. E. Henshaw, Merrow Publishing C°, Ltd., Watford, Herts, England, 1971; U.S. RE 27,717 Breen et al; U.S. Pat. No. 3,225,533 Henshaw; U.S. Pat. No. 3,306,023 Henshaw et al.; U.S. Pat. No. 3,353,344 Clendening, Jr.; U.S. Pat. No. 3,434,275 Backer et al.; U.S. Pat. No. 3,443,370 Walls; U.S. Pat. No. 3,507,108 Yoshimura et al.; U.S. Pat. No. 3,717,988 Walls; U.S. Pat. No. 3,775,955 Shah and U.S. Pat. No. 3,940,917 Strachan. In addition, the process for the manufacturing of an alternating S/Z cabled yarn is described in patent document WO 2012/059560. In addition, it needs to be noted that in document WO 2012/059560 a set of rollers is provided that possibly has a stabilizing effect on the different yarns in order to obtain a better alignment. Yet, by placing this after the air jets (for overtwisting the yarns) of the cabling installation (hence inside the cabling installation), there is still a considerable chance of interaction between the twist plying installations and the air jets of the cabling installation because the applied tensions and tractive forces on the yarns are propagated along the yarns. This leads to a poorer alignment of nodes in the yarns as well a less uniform twist that is applied to the yarns in the air jets of the cabling installation. In addition, any correction is too late since the yarns are already twisted at the time the set of rollers can manipulate the yarns. This makes it impossible to match the nodes applied by the first air jets (of the twist plying installation) to nodes applied by the air jets of the cabling installation.

In a further document U.S. Pat. No. 5,644,909, an equipment and method are described for manipulating yarns. Yet, in this case we are dealing specifically with a stop-go process for manufacturing not-connected plied yarns whereas the applicant in this document aims for a continuous process in view of the many advantages this offers regarding speed and simplicity (in functioning and maintenance) of the appropriate equipment. A set of rollers is used here to guide the (plied) yarns between the first twist plying installations and the cabling installation. Yet, the set of rollers manipulates all of the (plied) yarns together and cannot execute individual (relative) manipulations and cannot match the nodes of separate (plied) yarns to fix them. In document U.S. Pat. No. 5,644,909 it is also indicated that by a more precise control of a large number of parameters, the exact location of nodes in the (plied) yarns can be tracked in order to stop the stop-go process at the right times. The applicant has come to notice that the prediction thereof depends on a large number of additional parameters and that it can be predicted only with a certain variation, as discussed later on. In addition, the document only gives a method for the manufacturing of overtwisted (overtwined, overplied) alternating S/Z twist plied yarns that are not connected. A problem that occurs when the stop-go process of the document is expanded for the manufacturing of a effectively connected alternating S/Z twist plied yarns or an alternating S/Z cabled yarn (so also connected), this creates new practical problems since a second stop-go point should be added, this time to connect the two overtwisted alternating plied yarns at the cabling installation. The combination of the second stop-go process with the first which is already present in the method described in the document, will lead to a very inefficient functioning in practice, since these cannot be set to coincide. This leads to two separate stops and a much slower process and hence a lower production.

Existing systems for the manufacturing of (connected) alternating S/Z plied and/or cabled yarns are all based on the same principle. Applying alternating S/Z torsion or twist on several yarns in a torsion room of a similar mechanism and thereafter untwisting the yarns and make them intertwine (i.e. twist plying or cabling) in a following phase. It is important to indicate here that between the zones of S-torsion and the zones of Z-torsion there are substantially torsion-free zones present, called the nodes. For an optimal twist or cabling of the different yarns, it is advantageous and in many cases crucial that the yarns are combined very precisely. A longitudinal shift between the yarns can cause poor twist plying or cabling, since it is important that the torsion of the yarns in the combined zones is the same. For that reason, it is also tried to make the nodes of the different yarns coincide, or at least is completely as possible, to avoid the coinciding of zones with opposite twist but also to reduce the number of visible nodes in the resulting yarn. Twisting the yarns also leads to a change in length of the resulting plied yarn. The exact change in length is every difficult to predict since it depends on small differences in circumstances (strength of applied twist, temperature, humidity, pressure, yarn characteristics, etc.). Hence, the local change in length of the yarn can differ compared to earlier or later zones, which can cause a longitudinal shift of the yarn when feeding the yarn of the twist plying installation into the cabling installation. In addition, this shift can accumulate.

In most assemblies, the yarns are manufactured in a two-step process. In a first step, the separate yarns are fed into a twist plying installation where the yarns are twisted, connected and entangled by means of untwisting into a twist plied yarn, more specifically an alternating S/Z twist plied yarn. As said, a change in length can occur here which varies during the process.

In the second step, the twist plied yarns are fed into a cabling installation, which causes the twist plied yarns to be twisted, connected and entangled by untwisting into a cabled yarn, more specifically an alternating S/Z cabled yarn. Alternatively, a connected alternating S/Z twist plied yarn can be manufactured if the untwisting process is not completed. Also in this second step, in time a varying change in length can be seen in the yarn.

Due to the changes in length large tensions can arise on the yarns in and between the twist plying and cabling installations. These tensions can lead to breakage (of yarn and/or installations) but also to an unintentional change in pattern, for example by stretching or reducing zones with a certain twist or torsion. This is to be avoided in order to reach a more even distribution of zones and to produce a qualitatively better product. The problem as described is recognized a.o. in U.S. Pat. No. 4,055,040.

An additional problem that is also caused by this, is that tensions and forces on the yarns caused by the twist plying installations can have an influence on the functioning of the cabling installation or other installations and vice versa: that tensions and forces on the yarns coming from the cabling installation can have an influence on twist plying installations or other installations. In the latter case, it must be pointed out that when applying the twist on a yarn, this yarn will twist upstream as well as downstream and tensions in the yarn, specifically variations in tension, can also move downstream and upstream.

For example, there is the connection of the incoming yarns in the twist plying installations or in the cabling installation. That is done by tangling the separate incoming yarns, preferably by a short pulse of air, which causes the filaments of the different yarns to tangle. During this connection process, intermittent forces are applied to the yarns that can also be transferred to other installations.

The existing systems cannot prevent these problems. The current applicant has noticed that the mutual influence of the different installations or method steps are an important cause of the loss of quality of the resulting yarn. This has to do with the fact that it is very difficult or even impossible to predict the shift caused by the shortening of the yarn after twist plying and to compensate this. The applicant has noticed that the independent execution of the separate steps in the process for the manufacturing of alternating S/Z cabled yarns or connected alternating S/Z twist plied yarns will increase the quality substantially.

An example of an existing system is described in U.S. Pat. No. 4,170,868, in which no real improvements or adjustments are provided in order to compensate for the longitudinal variations on the yarns before these are guided to a following process.

There is a need for an improved installation and method for applying a precise spatial periodically alternating S/Z torsion onto a yarn and the following methods, installations and systems, such as for the manufacturing of alternating S/Z twist plied yarns and/or alternating S/Z cabled yarns and/or connected alternating S/Z twist plied yarns.

The present invention claims to find a solution for at least some of the above-mentioned problems.

SUMMARY OF THE INVENTION

In a first aspect, the invention concerns a system for the manufacturing of alternating S/Z cabled yarn or connected alternating S/Z twist plied yarn, including:

i. at least two twist plying installations, each for the manufacturing of an alternating S/Z twist plied yarn of groups of at least two incoming yarns;
ii. a cabling installation for the manufacturing of an alternating S/Z cabled yarn or a connected alternating S/Z twist plied yarn out of the at least two alternating S/Z twist plied yarns;

with the characteristic that between at least one, but preferably all, of the twist plying installations and the cabling installation a force compensation member is provided for applying a variable compensation for a part of the tractive forces on at least one but preferably all of said plied yarns between the at least one yet preferably all of the twist plying and cabling installations.

The described system is configured for the manufacturing of alternating S/Z cabled yarn or connected alternating S/Z twist plied yarn in a continuous mode, contrary to the most prior art systems that need to use a stop-go process to enable fixation. Further it must be understood that the force compensation member is configured for applying the variable compensation before the alternating S/Z twist plied yarns are overtwisted in the cabling installation, as is shown by the figures and other references in this document.

A cabling installation such as included in this document, typically includes several (at least two) overtwist jets for the overtwisting of the at least two separate alternating S/Z twist plied yarns). Typically, a twist plying installation includes a (twist plying) fixation member to connect the overtwisted incoming yarns. The force compensation member is positioned here between the fixation members of the twist plying installations on the one hand and the overtwist jet of the cabling installation on the other hand Preferably, the force compensation member is configured to provide a separate, variable compensation (equal or not) on different (preferably all) alternating S/Z twist plied yarns. In a first instance one such a force compensation member can be provided for the several alternating S/Z twist plied yarns. On the other hand, a similar force compensation member can also be provided per alternating S/Z twist plied yarn on which the variable compensation needs to be applied.

In a preferential embodiment, the force compensation member is an electrical force compensation member.

In a preferential embodiment, the force compensation member is a pneumatic force compensation member.

In a possible embodiment, the force compensation member is a passive force compensation member. Alternatively, the force compensation member is an active force compensation member. Preferably, the system includes a yarn tensometer following one of several twist plying installations and/or following the cabling installation, preferably between one of several of the twist plying and cabling installations. More preferably, the system has been adjusted to process information coming from the yarn tensometer and to adjust the variable compensation of the force compensation member by means of the processed information and/or taking into account the periodic aspects of information of the yarn tensometer. For this purpose, the system can include force adjustment elements and a compensation control system that is adapted to adjust the variable compensation.

In a preferential embodiment, the system is characterized by the fact that the force compensation member is adapted for executing an essentially constant tractive force onto the twist plied yarns.

In a preferential embodiment, the force compensation member includes a movable force suspension point and the force compensation member is equipped to compensate variations, and preferably high frequency variations, in the tractive forces on the one or several of the alternating S/Z twist plied yarns by moving the force suspension point in such a way that the path of one or more of the alternating S/Z twist plied yarns between one or several of the twist plying installations on the one hand and the cabling installation on the other hand is lengthened or shortened to execute an essentially constant tractive force on one or several of the alternating S/Z twist plied yarns. Here, it can be assumed that the movable force suspension point is suitable for lengthening or shortening a path between one or more of the twist plying installations and the cabling installation for one or more of the alternating S/Z twist plied yarns, in which the path is lengthened or shortened based on the tractive forces of one or more of the alternating S/Z twist plied yarns.

In a preferential embodiment, the system includes a pulling unit for pulling the cabled yarn or connected yarn with a certain pulling strength and/or at a certain pulling speed, in which the force compensation member includes a movable force suspension point for applying the variable compensation onto the twist plied yarns and in which the system includes a speed control system that is adapted for adjusting the pulling force and/or pulling speed based on a deviation of the movable force suspension point, preferentially to adjust it in such a way that the deviation of the movable force suspension point is steered toward a certain position. This position can for instance indicate an average deviation from the movable force suspension point.

In a preferential embodiment, the twist plying installations have each been provided with a (twist) ply fixation member to fixate each alternating S/Z twist plied yarn in plying nodes and in which the cabling installation has been provided with a cable fixation member to fixate the alternating S/Z cabled yarn or the connected alternating S/Z twist plied yarn in cabling nodes, in which the system has been provided with a calculating unit that is configured to virtually track said plying nodes between at least the twist plying installations and the cabling installation and in which the cable fixation member is adapted to fixate the alternating S/Z cabled yarn or the connected alternating S/Z twist plied yarn when at least one virtually tracked plying node is situated near the cable fixation member.

In an even more preferential embodiment, the system includes a controlling member, characterized by the fact that the controlling member has been adjusted to separately control the guidance of the alternating S/Z twist plied yarns in such a way that the plying nodes of the alternating S/Z twist plied yarns coincide in the cable fixation member, taking into account the history of measurements, corrections following the measurements and/or the consequences of the corrections and/or the measured yarn tensions and/or the encoding signals of rolls and/or the deviation of the force compensation member.

Preferably, the controlling member has been adjusted to have the cable fixation member connect the alternating S/Z twist plied yarns in coinciding nodes. As indicated, this will allow for the manufacturing of a more uniformly cabled yarn (or connected alternating S/Z twist plied yarn).

In a preferential embodiment one or more rolls have been provided between at least one of the twist plying installations and the cabling installation for the guidance of the alternating S/Z twist plied yarn and for the compensation of a part of the pulling forces on the alternating S/Z twist plied yarn between the at least one but preferably all of the twist plying installations and the cabling installation.

In a second aspect, the invention concerns a method for the manufacturing of alternating S/Z cabled yarn or connected alternating S/Z twist plied yarn, including the following steps:

a. twist plying at least two groups of two or several yarns in twist plying installations for the manufacturing of at least two alternating S/Z twist plied yarns;
b. feeding of the alternating S/Z twist plied yarns toward a cabling installation, where a pulling force is applied to the alternating S/Z twist plied yarns;
c. cabling of at least the alternating S/Z twist plied yarns in the cabling installation for the manufacturing of the alternating S/Z cabled yarn or the connection of at least the alternating S/Z twist plied yarns in the cabling installation to manufacture the connected alternating S/Z twist plied yarn;

characterized by the fact that the tractive force on at least one, but preferably all of the twist plied yarns during step b is adjusted by means of a force compensation member between at least one of the twist plying installations and the cabling installation, wherein in the tractive force is adjusted before the alternating S/Z twist plied yarns are overtwisted in the cabling installation. This means that it is a continuous method, as indicated further down in this document, which clarifies the necessity of the application of a similar adjustable tractive force and the advantages of which are clear. These shall be clarified further down in this document. Step b should also be read as the 'continuous feeding of' or the 'continually feeding of' or similar.

In a preferential embodiment, the tractive force shall be adjusted by adjusting the length of the twist plied yarns between the twist plying installations and the cabling installation.

In a preferential embodiment, the tractive force is kept constant on at least one but preferably all of the twist plied yarns during step b. The force compensation member (or the several force compensation members, depending on how elaborate the principle is applied) is configured to keep these tractive forces substantially constant in both longitudinal senses of the direction along the mentioned alternating S/Z twist plied yarns. In this way it is guaranteed that the yarn is "stretched" in view of the twist plying installation as well as the cabling installation. In existing systems and methods, a set of rollers can be provided between these two installations, where the absorption (and hence stabilization in order to keep this constant) of a tractive force between the twist plying installation and the set of rollers leads later on to a reverse adjustment of the tractive force on the yarn between the cabling installation and the set of rollers (or vice versa). This is caused by the first adjustment which will have an influence on the yarn tension on the side of the first adjustment, which will then relax or become more tense once the "adjusted" zone of the yarn passes by the set of rollers.

In a preferential embodiment, the tractive force is adjusted on at least one and preferably all plied yarns during step b with a force compensation member which applies a compensation force on the twist plied yarns. Specifically, this means that the tractive force on one and preferably all of the twist plied yarns is adjusted during step b by the force compensation member by applying a compensation force on the twist plied yarns, in which the force compensation member is configured for applying this compensation force on the twist plied yarns.

In a preferential embodiment, the adjustment of the tractive force on a twist plied yarn coincides with the adjustment of the length of the twist plied yarn between the twist plying installation and the cabling installation. More specifically, the tractive force is applied (or kept constant) by adjusting the length of the twist plied yarn between the twist plying installation and the cabling installation, by lengthening or shortening the followed path, according to the circumstances.

In a preferential embodiment, the force compensation member is configured for applying a variable compensation force for part of the tractive force on one or more of the alternating S/Z twist plied yarns and the force compensation member is provided between one or more of the twist plying installations and the cabling installation, in which the method includes the step of providing the variable compensation force by lengthening or shortening a path for the one or several alternating S/Z twist plied yarns between the one or several twist plying installations and the cabling installation.

In a preferential embodiment, the method is also characterized by the fact that the cabled yarn or connected yarn is pulled with a stretching force and/or at stretching speed, in which the stretching force and/or the stretching speed is adjusted, taking into account a change in length (modification of length) of the twist plied yarn between the twist plying installation and the cabling installation. Preferably, a deviation of a force compensation member is also taken into account, which applies a compensation force onto the twist plied yarns.

In a preferential embodiment, the method also includes a step in which a yarn tension of at least one and preferably all the twist plied yarns is measured between the twist plying installation and the cabling installation and in which preferably the tensile strength caused by the force compensation on the twist plied yarns is adjusted, taking into account the measured yarn tension.

In a preferential embodiment, it is a method for the manufacturing of alternating S/Z cabled yarns or connected alternating S/Z twist plied yarns and the method for plying the incoming yarns consists of the following steps:

i. twisting the at least two incoming yarns;
ii. subsequently, gathering the twisted yarns and
iii. the intertwining of the gathered twisted yarns in plying nodes;

after which the twist plied yarns are cabled by means of the following steps:

iv. twisting the at least two plied yarns;
v. subsequently, gathering the twist plied yarns and
vi. the intertwining of the gathered yarns in cabling nodes;

in which the plying nodes are virtually followed, so the intertwining of the twist plied yarns in step vi is executed at the plying nodes so the cabling nodes coincide with plying nodes of at least one and preferably all plied yarns.

This means that in step iv, when twisting the at least two plied yarns, these will be twisted in such a way that cabling nodes occur on the already present plying nodes of one and preferably all the twist plied yarns (so that the created cabling nodes substantially and as overlapping as possible coincide with the plying nodes). This can be realized by a very precise control of the position of the twist plied yarns (and specifically, verification of the position of the plying nodes) and for applying torsion or twist appropriately in (typically a first air jet installation of) the cabling installation. In that way, in step vi, the fixation of the separate plied yarns can be executed by stranding them in the cabling nodes, which coincide with the plying nodes of one or more of the twist plied yarns of which the cabled yarn or connected plied yarn consists.

In a preferential embodiment, the twisting of the at least two incoming yarns is executed under varying over pressure. The varying over pressure has the advantage that in this way, a cyclically falling twist (strength) is compensated, which is a common problem in these processes. Preferably, the varying over pressure has a periodically rising profile, e.g. a tooth saw profile with a very sharply falling flank. In a more preferable embodiment, the twisting of the at least two plied yarns is executed with varying over pressure with similar advantages. Preferably, the varying over pressure has a periodically rising profile, e.g. a tooth saw profile with a very sharply falling flank.

In a preferential embodiment, the plying of the yarns in the twist plying installations is executed under variable offered overpressure. Preferably, the varying offered overpressure follows a substantially periodical profile. When plying for the manufacturing of alternating S/Z twist plied yarns, the alternating S/Z twisted yarns are manufactured during an intermediate step. The alternating S/Z twisted yarns have subsequent alternating zones of S torsion and Z torsion, separated by nodes in which the sense of the torsion changes and there is substantially no torsion present. Even more preferably, the varying offered overpressure follows a substantially periodic profile with as period a time lapse between the processing of a node of the yarn up to a next node of the yarn in the twist plying installation. Even more preferably, one period of the profile is a rising function.

In a preferential embodiment, the virtual tracking of plying nodes takes into account the history of measurements, corrections following measurements and/or consequences of corrections and/or with measured yarn tensions and/or with encoder signals of rolls and/or with the deviation of the force compensation member.

In a preferential embodiment, the method as described in this document, executed with a system such as described in this document.

In a final aspect, the invention concerns an alternating S/Z cabled yarn or a connected alternating S/Z twist plied yarn manufactured according to a method such as described in this document.

Although in this document mainly embodiments have been discussed in which alternating S/Z twisted yarns are joined in phase, all these embodiments are also possible for joining in counter-phase without exceeding the scope of the invention.

DETAILED DESCRIPTION

Figure 1:
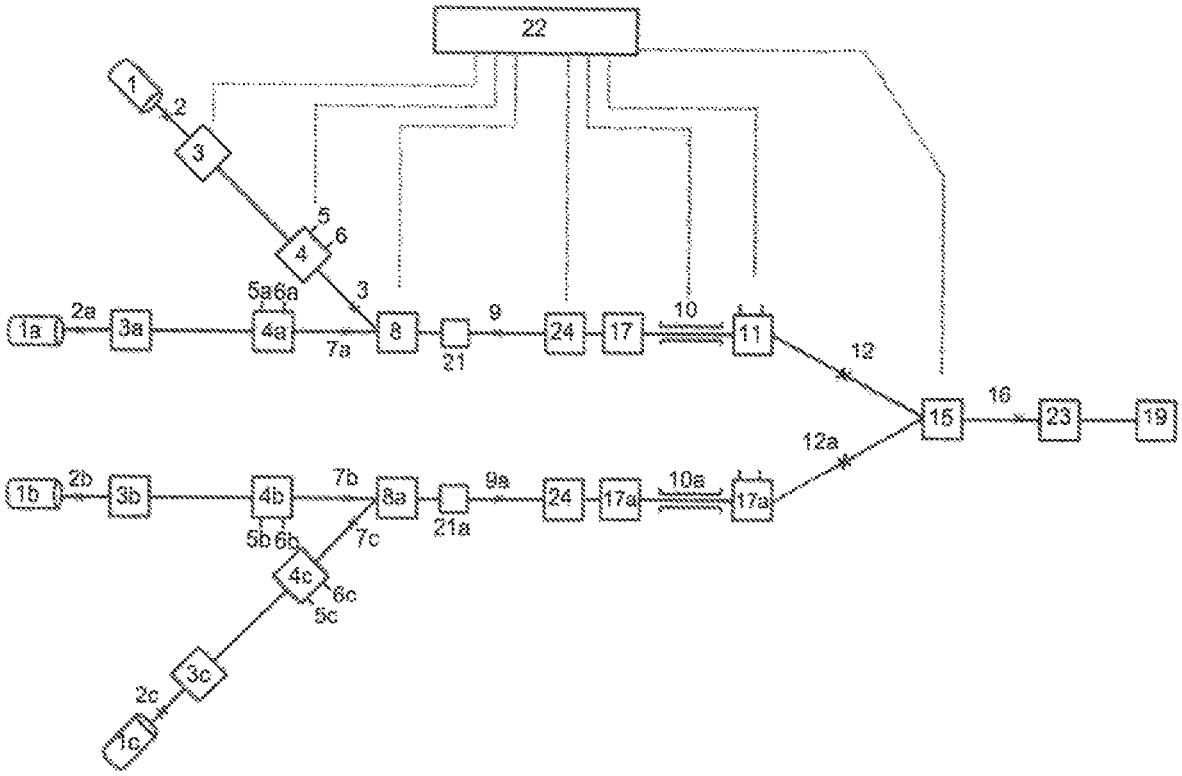
FIG. 1 shows a schematic representation of a possible embodiment of an installation for the manufacturing of alternating S/Z cabled yarn or connected alternating S/Z twist plied yarn.

Unless defined differently, all terms that are used in the description of the invention, including technical and scientific terms, have the meaning as is generally understood by the professional in the technical domain of the invention. In order to be able to assess the description of the invention better, the following terms will be explained explicitly.

"A", "the" and "an" in this document will refer to singular as well as plural, unless the context clearly indicates otherwise. E.g., "a segment" means one or more than one segment.

The terms "include", "including", "consist of", "consisting of", "provided with", "include", containing", "entailing", "entail", "contain", "containing" are synonyms and are inclusive or open terms that indicate the presence of the subsequent elements and that do not exclude or prevent the presence of other components, characteristics, elements, parts, steps, known from or described in the state of the art.

The term "yarn" refers to spun yarn, in this case containing several filaments, or BCF yarn (bulked continuous filament). The individual yarns typically have a diameter between 0.1 mm and 2 mm, the already plied yarns have a larger diameter, between 0.2 mm to 5 mm, depending on the circumstances and the number of incoming yarns. It is noted here that BCF yarn is compressible and that hence preferably the yarn numbers indicate the diameter or thickness of the yarn, as the ratio between mass and length of a piece of yarn. Practically, for individual yarns this comes down to a range from 250 dtex to 4000 dtex, and for plied yarns from 500 dtex to 10000 dtex. Smaller ranges are possible, e.g. 600 dtex to 2000 dtex for individual yarns and 1200 dtex to 5000 dtex for plied yarns, but this does not limit the applicability of the invention.

The term "force compensation member" refers to an element or subsystem that is adjusted to absorb changes in force (small and larger fluctuations on short and long term, specifically small fluctuations on short term) that take place on the (longitudinal) tractive force applied to a twist plied yarn between a twist plying installation and a cabling installation. Typically, this force compensation member will partially guide the yarn (or manipulate a guide of the yarn). In the document, some embodiments will be described in greater detail.

The term "passive force compensation member" refers to a force compensation member that does not follow an external actuator or control when compensating changes on the tractive force on a yarn. A passive force compensation member reacts following the proper physics of the passive force compensation member to changes that occur (comparable to the way a spring or piston on which a force is applied, is pressed down until a balanced resilience is created that can compensate for the external force). This can e.g. be a mechanical (e.g. spring) or pneumatic (e.g. piston) element and can preferably include a low constant force in order to react quickly to small and/or highly frequent differences (typically, these differences will be small in this context).

The term "active force compensation member" refers to a force compensation member that follows an external actuator or control when compensating for differences in the tractive force on a yarn. Typically, this is done based on measurement data concerning tractive force, e.g. by measuring these directly or via other routes, such as yarn tension and the likes. Based on the measurement data, the active force compensation member will then be controlled to execute a manipulation that causes a desired compensation (force) on the yarn. In other words, an active force compensation member does not react directly to differences in tractive force but reacts in accordance with instructions (that are typically based on differences in tractive force nonetheless). Certain regimes can be discovered in that way in the variability of the tractive force which needs to be compensated for after it has been noticed (e.g. periodical appearances following equipment or other effects).

The term "electric force compensation member" refers to a force compensation member that is electrically driven. Note that this does not mean that it is necessarily driven externally (which would make it an active force compensation member), only that the energy supply is electric for the functioning of the force compensation member (so also possible in passive mode).

The term "pneumatic force compensation member" refers to a force compensation member that is pneumatically driven, such as a pump or a cylinder.

The term "force suspension point" refers to a point or axis (or similar) on which the alternating S/Z twist plied yarns are fed between the twist plying installations on the one hand and the cabling installation on the other hand or that a conductor for the alternating S/Z twist plied yarns between the twist plying installations on the one hand and the cabling installation on the other hand supports and with which from the force suspension point the alternating S/Z twist plied yarns between the twist plying and cabling installations can be manipulated, e.g. by exercising a force and/or a movement.

The term "connect" refers to the connecting of several separate yarns or several separate, plied yarns in which the yarns contain several filaments. The yarns are connected by stranding some of these filaments together over a limited length, e.g. by bringing the separate yarns closer together and supplying these to an air flow pulse, and as such providing for the stranding of the filaments.

The term "overpressure" or "offered overpressure" at an air inlet refers to the pressure difference between the pressure at the air entrance and the pressure after the exit of the (torsion) chamber, in which a positive over pressure refers to a higher pressure at the air inlets than the pressure after the exit of the (torsion) chamber. In other words, the overpressure refers to the controllable over pressure with which air is offered to the (torsion) chamber through the air inlets.

The term "(twist) ply" and "(twist) plied" refers to the procedure or a characteristic of the product thereof in which one or more yarns are twisted around each other with a different set of one or more yarns.

The term "twist" and "twisted" refers to the procedure or a characteristic of the product thereof in which torsion is applied to a yarn, which leads to a deformation in which the energy of the torsion is stored on the yarn and leads visually to a twisted or distorted yarn.

The term "cabled" refers to a product that is obtained by twist plying at least one plied yarn with other yarns, which are preferably also twist plied yarns.

The term "alternating S/Z twisted" and "alternating S and Z twisted" and "alternating S/Z torsioned" and "alternating S and Z torsioned" refers to the condition of a yarn in which a spatially alternating torsion is applied.

The terms "alternating S and Z twist plied" and "alternating S/Z twist plied" refer to yarns that have been intertwined as a consequence of the application of alternating S/Z torsion on the yarns and the consequent self-twisting of the yarns. Note that the term "plied yarns" can occur in the text to shorten its writing. This term refers to, except when explicitly mentioned otherwise, to "alternating S/Z twist plied yarns" but creates no cause for confusion. The same remark can be made for the term "cabled yarns" which refers to "alternating S/Z cabled yarns". De term "connected yarns" refers to "connected alternating S/Z twist plied yarns".

The term "connected alternating S/Z twist plied yarns" refers to two or more alternating S/Z twist plied yarns that are provided with an alternating S/Z twist or torsion on at least one of the alternating S/Z twist plied yarns and are connected with each other in torsion-free nodes, in which zones with opposite torsion of the yarns are adjacent and there is no de-torsion. In addition, it must be noted that in this document, the processes and systems for the manufacturing of alternating S/Z cabled yarn can be adjusted easily to the manufacturing of connected alternating S/Z twist plied yarn (and vice versa) since this is an alternative product regarding the manufacturing of alternating S/Z cabled yarn and is as such considered a part of the invention.

In a first aspect, the invention relates to a system for the manufacturing of alternating S/Z cabled yarn or a connected alternating S/Z twist plied yarn as described in this document. This system is characterized by the provision of a force compensation member between at least one of the twist plying installations of the system and the cabling installation of the system. The force compensation member can provide for variable compensation for part of the tractive forces on one or several, preferably all of the twist plied yarns between the twist plying installation and the cabling installation.

As indicated, as well as recognized by the State of the Art, a frequent problem in such systems is that the twist plied yarns undergo a certain longitudinal contraction compared to the original non-manipulated yarns. This longitudinal contraction depends from yarn to yarn and addition per yarn also from zone to zone, since the yarns present on the one hand mild longitudinal deviations. These deviations are quite common and can regard the thickness of the yarn, the quality of the yarn as well as intrinsic yarn parameters (strength of the filaments, strength of the yarn, torsion resistance, local twisting levels, local yarn tension, . . . ) but also environmental parameters. The systems used to produce the yarn are becoming increasingly refined in order to manufacture better and more constant products, but small fluctuations in operational parameters (temperature, pressure, mass influx of air, . . . ) can never be excluded and they also have an influence on the longitudinal contraction. Longitudinal contractions can occur in the plying systems as well as in the cabling systems.

Since the contraction can vary considerably locally in the course of time, it is possible that a twist plied yarn which exits from a twist plying installation is subject to strong tractive forces toward the twist plying installation at an increased longitudinal contraction (regarding a prior longitudinal contraction). This force can reproduce itself along the length of the yarn, toward the cabling installation and even beyond. As such, the yarn that is being processed in the cabling system can undergo a longitudinal shift and be retracted toward the twist plying installation which can distort the (torsion and/or plying) pattern. A short, forceful tractive force can lead to breakage in the yarn or the filaments of the yarn. Alternatively, the cabling and/or twist plying installation can be damaged by a sudden change in tractive force. The shifting of the yarn can even continue beyond the twist plying installation toward the feeding systems or beyond the cabling installation toward the exiting systems that can be deregulated or damaged. In addition, the varying contraction of one of the twist plied yarns without appropriate measures can deregulate the proper synchronization between the twist plying installation and the cabling installation.

The invention solves this problem by providing for a force compensation member between a twist plying installation and a cabling installation, which makes it possible to compensate for any tractive force on a twist plied yarn between the twist plying installation and the cabling installation, depending on the tractive force on the twist plied yarn. As such, the varying tractive forces cannot reproduce along the yarn and deregulate the entire process and/or damage the system and/or the product.

Preferably, such a force compensation member is provided between the twist plying installations on the one hand and the cabling installation on the other. Even more preferably, such a force compensation member is provided between all the twist plying installations on the one hand and the cabling installation on the other. In addition, it is possible to provide a force compensation member that applies a variable compensation for a part of the tractive forces on several of the twist plied yarns, since this method allows for one or more central force compensation members to be provided instead of many local force compensation members.

By adding the force compensation member, the separate twist plying installations and the cabling installation can be separated from each other and deviations are not only isolated to an individual (twist plying or cabling) installation but also compensated in the individual installation.

A first possibility here is to provide a pneumatic force compensation member between or more of the twist plying installations and the cabling installation. A pneumatic system offers the advantage of simplicity in design and in controlling the pneumatic system. Since the separate twist plying installations and cabling installations are limited in size, and since it is strongly recommended to have the twist plying installations and the cabling installation close to each other, there is only limited room for the force compensation member. Hence, a compact design, as in pneumatic systems, is very advantageous in this situation. A clear advantage is that pneumatic systems have a very long lifespan, linked to high reliability, which is very important considering the high speed and very high frequency of use in these processes for the manufacturing of cabled yarn or connected yarn. In addition, the gas used from the pneumatic system is very suitable to absorb short shocks (due to tractive forces) and isolate the tractive forces from the rest of the system. A possibly pneumatic system can include a pneumatic cylinder, the functioning principles of which are known in the State of the Art, as described in U.S. Pat. No. 3,839,976, 8,015,913 or 4,907,495.

In a possible embodiment of the force compensation member this includes a movable pulley system along which the alternating S/Z twist plied yarn is guided between the twist plying installation and the cabling installation, and in such a way that a course along which the alternating S/Z twist plied yarn is normally guided, is longer than a direct course between the twist plying installation and the cabling installation. The pulley system can be moved, in which a pneumatic cylinder can provide an adjustment in the track along which the alternating S/Z twist plied yarn is guided. This adjustment can be a shortening as well as a lengthening of the track. In case of a sudden increase in the longitudinal contraction of the alternating S/Z twist plied yarn, the pneumatic cylinder can decrease the deviation of the pulley system to shorten the track and keep the total tractive force on the alternating S/Z twist plied yarn constant. On the other hand, in case of a sudden decrease in the longitudinal contraction of the alternating S/Z twist plied yarn, the pneumatic cylinder can increase the deviation of the pulley system to lengthen the track and keep the total tractive force on the alternating S/Z twist plied yarn constant.

An alternative option for lengthening or shortening the path is providing a force compensation member with a certain flexibility in the force compensation member itself, which causes the yarns that are being guided along the force compensation member can deform the force compensation member (or part thereof) (or have its resume its original form, partially or not). By providing a deformable material on or along which the yarns are guided, these shall automatically deform the material in case of a sudden increase of the tractive force to create a shorter path between the twist plying and cabling installation. If the tractive force is normalised, the force compensation member can return to a prior form or an intermediate stage. This can e.g. be a pulley system with a compressible track for yarn guidance.

In a preferential embodiment, the force compensation member is adapted to execute an essentially constant tractive force onto the twist plied yarns. The force compensation member can execute an essentially constant tractive force in both directions of the twist plied yarns, independent from each other. The "essentially constant tractive force" refers to the fact that the force compensation member adjusts itself to the twist plied yarn that is brought to or from the force compensation member and applies a constant total tractive force on the yarn. The constant tractive force can be set in advance to manufacture a qualitatively good plied yarn in the twist plying installations without it being too tense or too slack. As has been said, variations in longitudinal contraction may occur, which would cause the twist plied yarn that is being guided to the force compensation member to suddenly experience a different tractive force if the force compensation member were to exercise a fixed, absolute force. Since the force compensation member is adapted to execute tractive force, taking into account the tensions and forces on the twist plied yarns, it is possible to provide an essentially constant tractive force on the twist plied yarns, independent from the condition of the twist plied yarns, and a constant pulling speed can be kept after the twist plying installation.

A possible embodiment hereof lies in the feeding of the twist plied yarn of the twist plying installation to the cabling installation along a track of adjustable length. If the force compensation member needs to provide a larger compensation on the tractive force, the length of the track can be increased. Yet, if a lower compensation is required, the length of the track can be decreased. In addition, a similar system is only possible as long as the provided compensation for the twist plying installation has no to hardly any influence on the cabling installation.

In a preferential embodiment, the force compensation member has a movable force suspension point for applying the variable compensation onto the twist plied yarns. The movable force suspension point can already partially solve the varying longitudinal contraction by creating a longer or shorter path for the twist plied yarn, depending on the current longitudinal contraction.

In a further preferential embodiment, the system includes a pulling unit for pulling the cabled yarn or connected yarn with a specific pulling strength and/or at a specified pulling speed. In addition, the system contains a speed control system that is adapted to adjust the pulling strength and/or the pulling speed based on a deviation of the movable force suspension point, preferably in such a way that the deviation of the movable force suspension point is guided toward a certain position. By providing a similar speed control system, it is possible to adjust the pulling strength and/or pulling speed and to align the twist plying installation on which the force compensation member is installed and the cabling installation better. If the cabling installation were to try to exit yarn at a pulling speed that is too high for the twist plying installation(s), it is impossible to supply the twist plied yarn that is necessary to produce the cabled yarn or connected yarn. This can lead to (continuously growing) tractive forces that can disrupt the entire process and/or system. If the cabling installation were to try to exit the yarn at a pulling speed that is too low for the twist plying installation(s), additional plied yarn shall be supplied to the cabling installation. Again, this could cause problems, since the tension at which the twist plied yarns are moved through the cabling installation can change. Of course, this change can be compensated but it is more practical to prevent the problem by regulating the pulling speed and/or the tractive strength of the cabled yarn or connected yarn. Finally, it is more efficient to adjust the pulling speed of the cabling installation to the twist plying installations, since vice versa the pulling speeds would have to be adjusted mutually of all twist plying installations that feed yarn toward the cabling installation, instead of only adjusting the pulling speed of the cabling installation to the 'slowest' twist plying installation.

In a preferential embodiment, the system also includes a yarn tensometer after one or more of the twist plying installations, preferably after all of them and/or after the cabling installation. Optionally, one yarn tensometer can measure the yarn tension at several twist plying installations. In addition, the force compensation member includes further force adjustment elements to adjust the variable compensation that can be applied onto the twist plied yarns by the force compensation member. Even more preferably, the force compensation member includes a compensation control system that is equipped to adjust the variable compensation that is applied by the force compensation member on the twist plied yarns taking into account a yarn tension measured by the yarn tensometer and/or other information measured by the yarn tensometer.

In a preferential embodiment, every twist plying installation is provided with a ply fixation member to connect each of the alternating S/Z twist plied yarns to itself in one or more nodes. In addition, the cabling installation has been provided with a cable fixation member to fixate the alternating S/Z cabled yarn or the connected alternating S/Z twist plied yarn. In addition, the system had a calculating unit that has been provided to virtually track one or more nodes over at least a part of the track between the twist plying installations and the cabling installation, in which the cable fixation member is adapted to fixate the alternating S/Z cabled yarn or connected yarn when at least one virtually tracked node is located near the cable fixation member.

It must be noted here that the expression "to connect itself to one or more nodes" regarding the alternating S/Z twist plied yarns (and similar expressions) regards the connection of the separate yarns of which an alternating S/Z twist plied yarn is constructed. In addition, this also applies to the use of the expression regarding alternating S/Z cabled yarns or connected yarns in which the separate (in this case alternating S/Z twist plied) yarns of which a cabled yarn consists, are connected in the nodes.

It is important that the fixation of the alternating S/Z cabled yarn or the connected yarn is done at the nodes where the separate alternating S/Z twist plied yarns are fixated. In that way a yarn of better quality is produced because the stranding is best done in such a way that nodes were the alternating S/Z cabled yarn or the connected yarn are fixated coincide with the nodes where the alternating S/Z twist plied yarns coincide. By having said nodes coincide better, it is also possible to execute the fixation of the alternating S/z cabled yarn or the connected yarn at lower pressure (until below 6 bar but possibly lower, below 5 bar, 4 bar, 3 bar), which saves energy and is less of a burden on installation and yarn. In addition, the connections (connected or fixated nodes) are also shorter because they coincide more. In case of existing installations, it often happens that nodes do not coincide but partially overlap, producing a longer connection. In addition, in this way an aesthetically more pleasing yarn is produced since on a more limited number of places yarns are visibly tacked, and limited in length.

If connections through the cable fixation member are longer or equal to the connections through the ply fixation members, the cable fixation member can be adapted to make sure that the connections of the ply fixation member are included in or coincide with the connections of the cable fixation member; On the other hand, If connections through the cable fixation member are shorter or equal to the connections through the ply fixation members, the cable fixation member can be adapted to make sure that the connections of the cable fixation member are included in or coincide with the connections of the cable fixation member; Here, consideration can be given to the history (prior processed data, prior corrections based on processed data, the exactitude of the prior corrections) as well as of actual values of measured yarn tensions and/or encoding signals of rolls and/or the deviation of the force compensation member and other values.

To make this possible, the calculation unit must be provided, which is suitable to track one or more nodes virtually, preferably along a track that is as complete as possible between the twist plying and the cabling installation and more preferably until as close as possible to the cable fixation member, to make sure a location is known of the virtually tracked nodes until the moment on which they need to be fixated. Again, consideration can be given to the history (prior processed data, prior corrections based on processed data, the exactitude of the prior corrections) as well as of actual values of measured yarn tensions and/or encoding signals of rolls and/or the deviation of the force compensation member and other values.

In a further preferential embodiment, the system includes a control member. This control member is adjusted to separately control the feeding of the alternating S/Z twist plied yarns to make sure that nodes of the alternating S/Z twist plied yarns coincide in the cable fixation member. This is a.o. recommended to obtain a connection on the yarns that is as short as possible but also to create a qualitatively acceptable alternating S/Z cabled yarn or connected yarn where the alternating S/Z twist plied yarns are brought together as exactly as possible in phase (or alternatively in counter-phase). Shifts in phase from the alternating S/Z twist plied yarns in view of each other create an aesthetically and qualitatively unacceptable product.

A possibility is e.g. to lengthen or shorten the track along which an alternating S/Z twist plied yarn is guided to the cable fixation member, to make shore the node of said alternating S/Z twist plied yarn coincides with the node of one or more other alternating S/G plied yarns.

Preferably, the control member is adjusted to have the cable fixation member connect the alternating S/Z twist plied yarns in coinciding nodes. Here, the control member preferably takes into account a history of measurements, corrections as a consequence of the measurements and/or consequences of the corrections and/or with measured yarn tensions and/or with encoding signals of rolls and/or with deviation of the force compensation member. By having a single control member making sure that the nodes of the alternating S/Z twist plied yarns coincide in the cable fixation member as well as the controlling of the cable fixation member to effectively connect these nodes, there is more certainty that the cable fixation member shall connect the alternating S/Z twist plied yarns at a correct place or time.

In a preferential embodiment, one or more rolls are provided between at least one of the twist plying and cabling installations. The rolls are adapted for guiding the alternating S/Z twist plied yarn and compensating a part of the tractive forces on the alternating S/Z twist plied yarn between the at least one of the twist plying installations and the cabling installation. Preferably, these rolls are provided between all the twist plying installations and the cabling installation. Examples of rolls for a similar guiding system are nip rolls, capstan overfeed rolls, open roll systems, cartled rolls but not limited thereto in any way.

In a second aspect, the invention concerns a method for the manufacturing of alternating S/Z cabled yarn or connected alternating S/Z twist plied yarn. The method includes the following steps:

a. twist plying at least two groups of two or more yarns in twist plying installations for the manufacturing of at least two alternating S/Z twist plied yarns;
b. feeding of the alternating S/Z twist plied yarns to a cabling installation in which a tractive force is applied on the alternating S/Z twist plied yarns;
c. cabling of at least the alternating S/Z twist plied yarns for the manufacturing of the alternating S/Z cabled yarn or the connection of at least the alternating S/Z twist plied yarns in the cabling installation for the manufacturing of the connected alternating S/Z twist plied yarn;

This method is characterized by the fact that the tractive force is adjusted on at least one and preferably all of the twist plied yarns of step b.

This measure offers a solution for the problems regarding the longitudinal contraction of the yarns and the consequences thereof, as already described in this document.

In a preferential embodiment, the tractive force is essentially kept constant on at least one and preferably all of the alternating S/Z twist plied yarns during step b. For the meaning of "essentially constant", we refer to a previous explanation in this document. This comes down to a tractive force that adjusts itself to the circumstances of the twist plied yarns, making sure a total tractive force is executed on the twist plied yarns in which the total tractive force is constant. The advantages hereof have already been discussed.

In a preferential embodiment, the tractive force is adjusted on at least one and preferably all of the twist plied yarns during step b with a force compensation member which applies a compensation force on the twist plied yarns. The variable compensation force keeps the tractive force essentially constant.

In a preferable embodiment, the adjustment of the tractive force in a twist plied yarn coincides with the adjustment of the length of the twist plied yarn between the twist plying installation and the cabling installation.

In a preferential embodiment, the method is characterized by the fact that the alternating S/Z cabled yarn or the connected yarn is pulled with a pulling force and/or a pulling speed. The pulling force and/or pulling speed is adjusted, taking into account a change in length of the alternating S/Z twist plied yarn between the twist plying installation and the cabling installation. Preferably, consideration is given here to a deviation of a force compensation member which applies a compensation force on the twist plied yarns. Specifically, the change in length refers to a time-related lengthening or shortening of the yarn between the twist plying and the cabling installation. As discussed, this can be caused by a number of circumstances and leads to the fact, in case the twist plied yarn is shortened less by the twist plying process, that the twist plied yarn slacks between the twist plying and the cabling installation and hence, is somewhat longer. On the other hand, this could also lead to a shortening. In both situations, this can be measured and the pulling force and/or speed can be adjusted to compensate (and not to damage the yarn or the equipment).

In a preferential embodiment, the variations and specifically high frequency variations in the tractive forces on one or more of the alternating S/Z twist plied yarns are compensated by moving the force suspension point in such a way that the path of the one or more of the alternating S/Z twist plied yarns between one or more of the twist plying installations on the one hand and the cabling installation on the other hand is lengthened or shortened to exercise an essentially constant tractive force on the one or more of the alternating S/Z twist plied yarns.

In a preferential embodiment, the method includes a characteristic step in which a yarn tension of at least one and preferably all of the twist plied yarns are measured between the twist plying installation and the cabling installation. Preferably, the pulling force in the twist plied yarns is adjusted taking into account the measured yarn tension.

In a preferential embodiment, the incoming yarns are plied by:

i. twisting the at least two incoming yarns;
ii. consequently gathering the twisted yarns and
iii. entangling the gathered twisted yarns into plying nodes;

The method is characterized by the fact that the twist plied yarns are cabled by:

iv. twisting the at least two plied yarns;
v. subsequently the gathering of the twist plied yarns, in which zones of plied yarns with the same twisting direction coincide and
vi. entangling the gathered plied yarns into cabling nodes;

in which the plying nodes are tracked virtually so the entangling in step vi of the twist plied yarns is executed at the plying nodes so that the cabling nodes coincide with plying nodes of at least one but preferably all of the twist plied yarns.

In an alternative preferential embodiment, it is a method for the manufacturing of connected alternating S/Z twist plied yarn and the method is characterized by the fact that the incoming yarn is plied by:

i. twisting the at least two incoming yarns;
ii. consequently gathering the twisted yarns and
iii. entangling the gathered twisted yarns into plying nodes;

characterized by the fact that the twist plied yarns are connected by:

iv. twisting the at least two plied yarns;
v. subsequently the gathering of the twist plied yarns, in which zones of plied yarns with opposite twisting direction coincide and
vi. entangling the gathered plied yarns into cabling nodes;

in which the plying nodes are tracked virtually so the entangling in step vi of the twist plied yarns is executed at the plying nodes so that the cabling nodes coincide with plying nodes of at least one but preferably all of the twist plied yarns.

As already indicated, it is important for the quality as well as for aesthetic reasons that the cabling nodes coincide as well as possible with the plying nodes, preferably in such a way that the plying node completely includes its cabling node or vice versa. By virtually tracking, an improved overlap can be provided and thus a better final product.

Normally, torsion (or twist) is applied to a yarn by feeding the yarn through a first part of a twist plying installation, i.e. a twist jet, where an air stream is created by over pressure in a chamber through which the yarn is pulled. The air stream is tangential and applies torsion or twist to the yarn. The applicant has noted here that the quantity of torsion that is applied per unit of length onto a yarn depends on the local torsion of the yarn. Here, we refer to the torsion present on the yarn that is further and/or prior in the twist jet or outside. In that way, it is possible that a unit of length of the yarn shortly after a node is torsed more than a unit of length of the yarn further down after the node because of the torsion that is present on other zones of the yarn shorter after the node, the application of torsion on the unit of length weakens further down after the node. In this way, an uneven quantity of torsion is applied on the length of the yarn, especially with a (periodically recurring) uneven twist between two following nodes. The applicant has noted here that the quantity of twist that is applied per unit of length onto a yarn depends on the local torsion of the yarn. In addition, the applicant has noted that the value of the over pressure at which the air stream is created has an influence on the quantity of torsion that is applied onto a yarn with a certain local torsion. By combining these two facts together, a yarn with an even torsion can be manufactured, which will improve the uniform look of the finished product as well as the quality by improved tacking.

The invention of the applicant lies in the solution for the problem by plying the yarns in the twist plying installation under varying over pressure, in which air supply is provided. Preferably, the varying overpressure follows a substantially periodic profile When twist plying for the manufacturing of alternating S/Z twist plied yarns, alternating S/Z twisted yarns are manufactured in an intermediate step. The alternating S/Z twisted yarns have subsequent alternating zones of S torsion and Z torsion, separated by nodes of which the rotation direction of the applied torsion changes and where there is substantially no torsion present. More preferably, the varying overpressure follows a substantially periodic profile with as period a time between the creating of a node in the yarn up to the creating of a following node of the yarn in the twist plying installation. This time can be set by an operator. Even more preferably, the profile during one period is a rising function. The profile can be a stepped process but can also be a polynomial function or combinations thereof. It is to be expected that a fixed profile can be provided for the varying over pressure to overcome said problems, since the problem shall occur periodically under substantially identical circumstances. It is advisable to compensate for small variations. Hence, in a more preferable version the profile of the varying over pressure is adjusted by means of information regarding torsion of the torsed yarn, such as local torsion. In that way, a faster correction is possible in case of variations and a more uniform torsion can be applied. By executing the method with a rising profile for the over pressure, it is also possible to execute the process, partially or not, in case of lower over pressures than normal (9 bar and more), used in similar methods. This will save a lot of energy, since it takes a lot of energy to keep these high over pressures.

The same principle can be followed for the cabling installation, where an overtwist jet has the same functionality as the twisting jet described before. Again, it is recommended that the overtwist jet provides a (tangential) air stream for the application of torsion on the alternating S/Z twist plied yarns that are manipulated in the overtwist jet. The air stream is provided by a varying over pressure due to similar reasons as for the twisting jet, with the same preferences as described. The over pressure can be controlled again and follows preferably a substantially periodic profile with again as period the time between the creation of two subsequent nodes in the overtwist jet. The profile is preferably during the course of one period a rising function, e.g. stepped, polynomial or combinations thereof. In an even more preferable version the profile can be adjusted by means of data, such as the local torsion of the yarn in the overtwist jet.

The system according to the invention is equipped in a preferable embodiment to execute the steps of the previous paragraphs. The system can include one or more twist jets and/or one or more overtwist jets, suitable for creating a (tangential) air stream in a chamber of the twist jet, through which the yarn can be fed, where the air stream is created by introducing air in case of over pressure. The system has been adjusted so that the offered over pressure at the twist jet can be varied, preferably in accordance with a profile such as described in previous paragraphs. Preferably, the over pressure can be steered by the control unit based on data coming from a torsion measuring element shortly after the twist jet. The control unit can do so correctively or can adjust the over pressure profile.

In a most preferable embodiment the method described in this document is executed with a system such as described in this document.

Finally, the invention also concerns an alternating S/Z cabled yarn or a connected alternating S/Z twist plied yarn that has been manufactured according to one of the methods described in this document. The alternating S/Z cabled yarn or connected yarn is of an increased structural quality, e.g. the better alignment of the cabling and plying nodes and an increased aesthetic quality such as already described in the methods and systems in this document.

All possible combinations of the embodiments described in this document are part of this invention, including the logical complements to the invention as would be clear for a man of the trade.

Hereinafter, the invention is described by means of non-limiting examples that illustrate the invention and that are not meant to be interpreted in order to limit the scope of the invention.

EXAMPLES

Example 1

In this example, the system for the manufacturing of alternating S/Z cabled yarn or connected yarn from FIG. 1 is discussed, including the method according to which the system operates.

The shown method is a continuous process: i.e. the supplied yarns and the produced yarns are running throughout the process and the system at a speed up to 200 m/min and even at higher speeds, such as 300 m/min, 500 m/min, 1000 m/min and without intermittent stops.

The individual incoming yarns (2, 2*a*, 2*b* and 2*c*) are coming from a yarn supply. These are usually coils (1, 1*a*, 1*b* and 1*c*).

By means of the yarn tensioners (3, 3*a*, 3*b* and 3*c*) the incoming yarns (2, 2*a*, 2*b* and 2*c*) are brought up to the desired yarn tension and then led to the air jet installations (4, 4*a*, 4*b* and 4*c*).

These air jet installations are generally known: by alternatingly adding compressed air alternatingly to the air inlets and/or jet pipes (5 and 6 respectively 5*a* and 6*a*, 5*b* and 6*b* and 5*c* and 6*c*) at the outlet side of these air jet installations alternating S/Z twisted yarns are created (7, 7*a*, 7*b* and 7*c*).

Immediately after the air jet installations (4 and 4*a*), the alternating twisted yarns (7 and 7*a*) are joined, preferably in phase (or alternatively in counter-phase). i.e. with the zones of similar twisting direction and the nodes next to each other.

This joining can be done in the ply fixation member (8) that connects the nodes of the alternating twisted yarns (7 and 7*a*). Such a ply fixation member can be a tacking jet (installation) or a connecting jet (installation) as is generally known in the industry.

At the same time, the same is done to the yarns (7*b* and 7*c*): they will be joined as soon as possible and their nodes will be connected in the ply fixation member (8*a*). In general, the combination of two air jet installations (4 and 4*a*, or 4*b* and 4*c*) and the following ply fixation member (8 or 8*a*) can be considered a twist plying installation according to this document.

By a self-twisting process, immediately after the ply fixation member (8 respectively 8*a*) an alternating S/Z twist plied yarn is created (9 respectively 9*a*) with alternating zones of S-ply and Z-ply with in between the nodes.

Between the twist plying installation, specifically after the ply fixation member (8 respectively 8*a*) and the cabling installation, specifically for the overtwist jet (11 respectively 11*a*) a force compensation member (24) is provided. This force compensation member (24) can include force adjustment elements and/or a compensation control system. The force compensation member (24) can effect each of the twist plied yarns separately or all of the twist plied yarns together.

In the overtwist jet (11 respectively 11*a*), the alternating plied yarns (9, respectively 9*a*) are twisted alternatingly, preferably in phase (or alternatively in counter-phase) with the already formed alternating S/Z ply on the alternating plied yarns. This causes the unbalanced alternating S/Z twist plied yarns (12 and 12*a*).

These yarns as well (12 and 12*a*) will be joined as soon as possible and their nodes will be connected in a cable fixation member (15).

In general, the combination of two overtwist jets (11 respectively 11*a*) and the following cable fixation member (15) can be considered a cabling installation according to this document.

After the fixation member (15) of the cabling installation, optionally a pulling unit can be provided to pull the cabled yarn or the connected yarn, after which the following process (19) can take place.

If the unbalanced alternating S/Z twist plied yarns (12 and 12*a*) are joined in phase (or alternatively in counter-phase), these shall undergo a spontaneous self-twisting process after the cable fixation member (15) thus creating an alternated S/Z cabled yarn (16).

If the unbalanced alternating S/Z twist plied yarns (12 and 12*a*) are joined in counter-phase, these shall not undergo a self-twisting process after the cable fixation member (15). The torsion tensions in both yarns are opposite. Connecting the nodes in both yarns (12 and 12*a*) makes sure that both yarns keep their unbalanced twist, including over the nodes and the produced yarn 16 essentially consists of both yarns (12 and 12*a*) next to each other, yet connected to each other in the nodes.

Note that yarn tensometers (17 respectively 17*a* can be provided for between the twist plying installations and the cabling installation with the same advantages, the minimalizing of the variations in yarn tension and the consequences of longitudinal contractions between the twist plying installations and the cabling installation.

In another embodiment of the invention, the alternating S/Z twist plied yarns (9 and 9*a*) are heated before the overtwist jet (11 and 11*a*) by generally known yarn heaters (10 and 10*a*) such as infrared radiation in order to weaken the filaments and increase the tackability of the nodes in the cable fixation member (15). This will also increase the twist levels at overtwisting.

In another preferential embodiment of the invention, in the overtwist jets (11 and 11*a*) a hot fluid such as hot air or steam will be used to weaken the filaments and to improve the tackability of the nodes in the cable fixation member (15). This will also increase the twist levels at overtwisting.

In a further preferential embodiment of the invention, in the cable fixation member (15) a hot fluid such as hot air or steam will be used to weaken the filaments and to improve the tackability of the nodes in the cable fixation member (15).

In another preferential embodiment of the invention, certain liquid additives can be applied onto the fibres or filaments in order to decrease the mutual friction and hence to improve the tackability of the nodes in the cable fixation member (15). These additives can be applied onto the yarns by means of the generally known applicators (21 and 21*a*) (kiss-roll, humidification jets, etc.) in the yarn path before the cable fixation member (15) or can be mixed with the fluid in the cable fixation member (15).

Finally, in each of the embodiments, a control unit (22) can be provided for the coordinated control of all actuators.

Please not that in the previous example the different types of control systems (e.g. control system, speed control system, calculation unit, control member and other) can be included in a central control unit (22) or can be separate systems.

Example 2

Figure 2A:
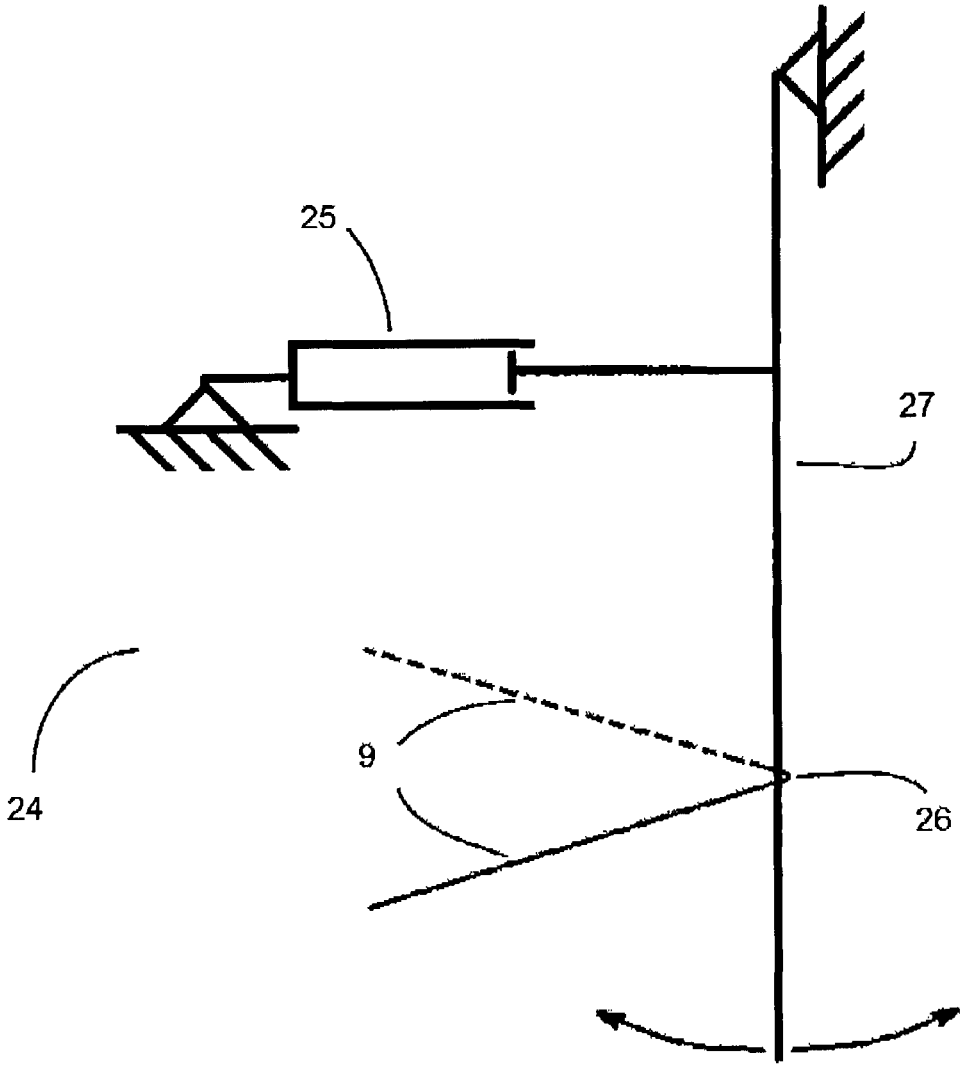
FIG. 2A and FIG. 2B show schematic representations of possible force compensation members with movable force suspension points, suitable to feed a (plied) yarn in between two processes.

In FIG. 2A we see a possible embodiment of a force compensation member (24). We can see here how a yarn is fed around a movable force suspension point (26). The position of this force suspension point (26) is determined on the one hand by the tension of the yarn (9) and on the other hand by the force that is executed on a deviation transferring element (27) which is connected with the force suspension point (26). This transferring element (27) can be a simple bar-shaped element, as indicated in FIG. 2A. Even though the functioning is already clear, we shall provide a concise description of the principle. Note that simple adjustments are possible in the position of the element without essentially changing the principle of functioning.

The yarn (9) is led around a force suspension point (26). In case of a longitudinal contraction of the yarn (9), an increased yarn tension were to occur which moves the force suspension point (26) to the left. Without a correction, this would lead to a higher tractive force being executed onto the yarn (9) since this would be pulling at a fixed speed at the yarn (9) without taking into account the sudden contraction. The much higher tractive force makes it possible for the yarn (9) to jump and the yarn (9) is pulled forward abruptly in order to compensate for the longitudinal contraction. In extreme cases, even rupture is possible.

Figure 2B:
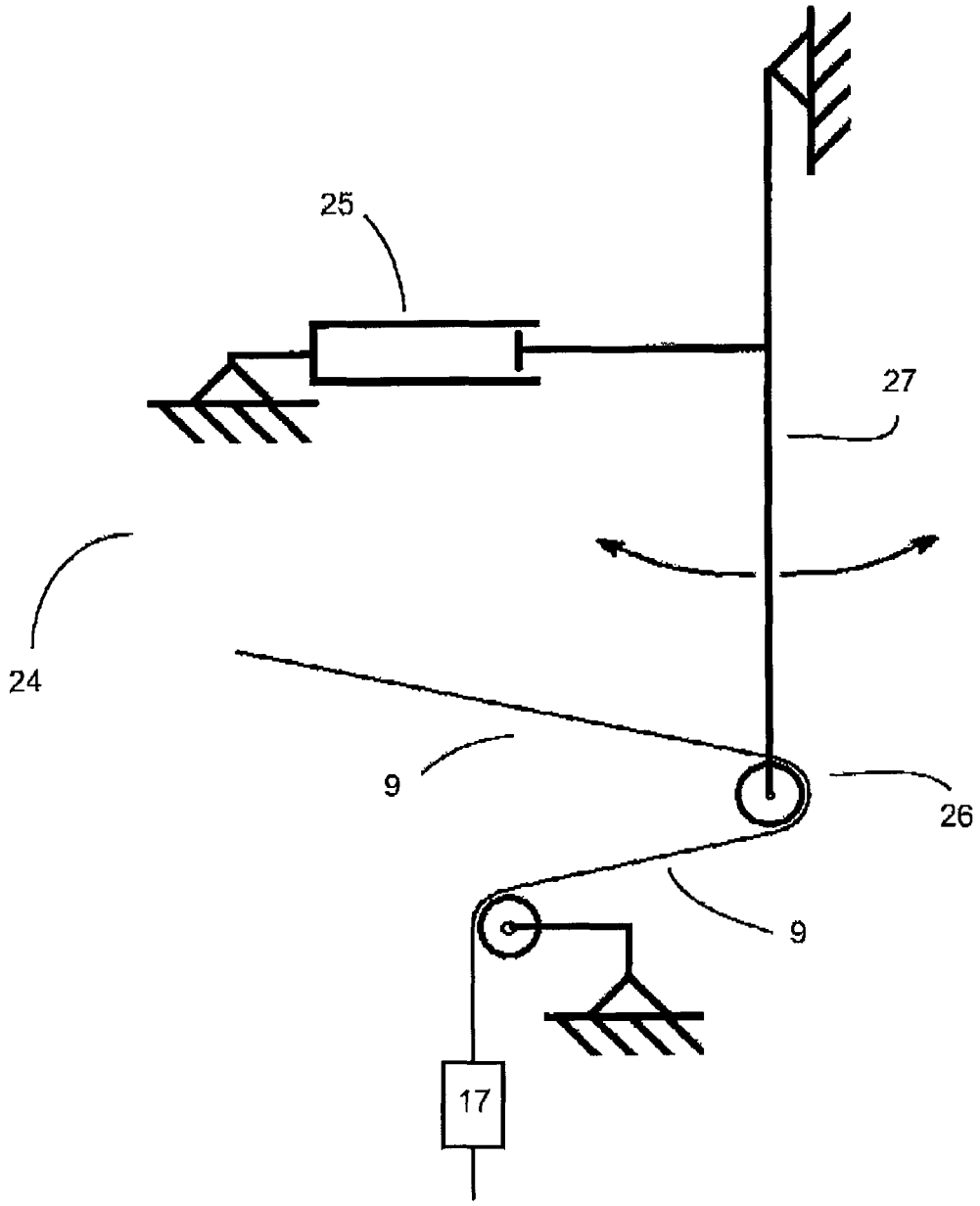

The movement of the force suspension point (26) provides in the possible solution in FIG. 2 for a deviation of the deviation transferring element (27) also to the left, by compressing a piston of a pneumatic cylinder (25) and compensating for the longitudinal contraction of the yarn (9) by providing a new balancing position for the force suspension point (26). In this way, the longitudinal contraction of the yarn (9) is compensated in such a way that the yarn (9) is pulled at a constant speed and force from the twist plying installations (and optionally also from the cabling installations).

Alternatively, at an elongation of the yarn (9), the force suspension point (26) shall move to the right in order to stretch the yarn (9) again. Without this correction the pulling unit (23) would abruptly experience no resistance when pulling and the elongated yarn (9) would be stretched first before the yarn (9) is pulled out of the twist plying installation again. In order to avoid this, the path of the yarn (9) is lengthened by repositioning the force suspension point (26), in which this repositioning is verified again by the presence of the pneumatic cylinder (25) that deviates along with the force suspension point (26) and as such reaches a balance. In a second option according to FIG. 2B a movable pulley element is used as a force suspension point (26) that is suitable to feed the yarn (9). After the force compensation member, in this embodiment there is also a yarn tensometer (17) that can also occur in other embodiments as well.

Alternatively, also a servo electrical motor can be used as a force compensation member according to the same principle in which the force suspension point (26) is moved by the servo electrical motor.

It is supposed that the current invention is not limited to the embodiments as described above and that several adjustments or changes can be added to the described examples without re-evaluating the added claims. For example, the current invention was described with reference to the introducing of an alternating S/Z torsion onto a yarn, but it must be clear that the invention, methods, torsion members and installations can also be applied to e.g. several yarns in a chamber or other ground products than yarns or for introducing a single, non-alternating torsion onto a yarn or on several, plied or unplied yarns.

The invention claimed is:

1. System for manufacturing of alternating S/Z cabled yarn or connected alternating S/Z twist plied yarn in a continuous fashion, including:

a at least two twist plying installations, each for manufacturing an alternating S/Z twist plied yarn from at least two incoming yarns, in which the twist plying installations each include a ply fixation member to connect the incoming yarns;

b a cabling installation for manufacturing an alternating S/Z cabled yarn or a connected alternating S/Z twist plied yarn from the at least two alternating S/Z twist plied yarns, in which the cabling installation includes at least two overtwist jets for the overtwisting of the at least two alternating S/Z twist plied yarns;

characterized by the fact that between at least one of said at least two twist plying installations and the cabling installation a force compensation member is provided for applying a variable compensation for part of the tractive forces on at least one of the said alternating S/Z twist plied yarns between the at least one of said at least two twist plying installations and the cabling installation, in which the force compensation member is positioned between the fixation members of the twist plying installations on a first side and the overtwist jet of the cabling installation on a second side and in which the force compensation member is configured for applying the variable compensation before the alternating S/Z twist plied yarns are overtwisted in the cabling installation.

2. System in accordance with claim 1, characterized by the fact that between the cabling installation and each of the twist plying installations a force compensation member is provided, and in which the separate force compensation members are suitable for applying a variable compensation for at least a part of the tractive forces on the separate alternating S/Z twist plied yarns between the cabling installation and the twist plying installations.

3. System according to claim 1, in which the force compensation member is an electric force compensation member or a pneumatic force compensation member.

4. System according to claim 1, in which the force compensation member is an active force compensation member, in which the active force compensation member takes into account or does not take into account time-related periodical aspects in the system; or in which the force compensation member is a passive force compensation member.

5. System according to claim 1, characterized by the fact that the force compensation member is adapted to maintain the tractive force on the alternating S/Z twist plied yarns essentially constant.

6. System according to claim 1, characterized by the fact that the force compensation member is adapted to compensate variations, in the tractive forces on one or more of the alternating S/Z twist plied yarns by moving the force suspension point in such a way that the path of the one or more of the alternating S/Z twist plied yarns between one or more of the twist plying installations on the first side and the cabling installation on the second side is lengthened or shortened, thereby exercising an essentially constant tractive force on the one or more of the alternating S/Z twist plied yarns.

7. System according to claim 1, in which the system includes a pulling unit for pulling the cabled yarn or the connected yarn at a specific pulling force and/or a specific pulling speed, in which the force compensation member includes a movable force suspension point for applying the variable compensation onto the twist plied yarns and in which the system includes a speed control system that is adapted to adjust the pulling strength and/or speed based on the deviation of the movable force suspension point.

8. System according to claim 1, in which the twist plying installations have each been provided with a ply fixation member to connect each of the alternating S/Z twist plied yarns with itself in one or more nodes, and in which the cabling installation is provided with a cable fixation member to fixate the alternating S/Z cabled yarn or the connected alternating S/Z twist plied yarn, in which the system is provided with a calculation unit which is adapted to virtually track the said one or more nodes over at least a part of a track between the twist plying installations and the cabling installation and in which the cable fixation member is adapted to fixate the alternating S/Z cabled yarn or the connected alternating S/Z twist plied yarn when at least one virtually tracked node can be found at the cable fixation member.

9. System according to claim 8, in which the system includes a control member, characterized by the fact that the control member is adjusted to separately control the feeding of the alternating S/Z twist plied yarns in such a way that nodes of the alternating S/Z twist plied yarns coincide in the cable fixation member, where one takes into account a history of measurements of yarn tensions, corrections following measurements and/or consequences of corrections and/or with encoder signals of rolls and/or with deviation of the force compensation member.

10. Method for the continuous manufacturing of alternating S/Z cabled yarn or connected alternating S/Z twist plied yarn, including the following steps:

a twist plying at least two groups of two or more yarns in twist plying installations for the manufacturing of at least two alternating S/Z twist plied yarns;

b continuously feeding of the alternating S/Z twist plied yarns to a cabling installation in which a tractive force is applied on the alternating S/Z twist plied yarns;

c cabling of at least the alternating S/Z twist plied yarns in the cabling installation for the manufacturing of the alternating S/Z cabled yarn or the connection of at least the alternating S/Z twist plied yarns in the cabling installation for the manufacturing of the connected alternating S/Z twist plied yarn;

characterized by the fact that the tractive force is adjusted during step b by a force compensation member on at least one of the at least two alternating S/Z twist plied yarns between at least one of the twist plying installations and the cabling installation before the alternating S/Z twist plied yarns are overtwisted in the cabling installation.

11. Method according to claim 10, in which the tractive force on at least one of the twist plied yarns during step b is adjusted with the force compensation member by applying a compensation force onto the twist plied yarns.

12. Method according to claim 10, in which the adjusting of the tractive force on a plied yarn is done by adjusting the length of the twist plied yarn between the twist plying installation and the cabling installation.

13. Method according to claim 10, in which the force compensation member is configured for applying a variable compensation force for part of the tractive force on one or more of the alternating S/Z twist plied yarns and in which the force compensation member has been provided between one or more of the twist plying installations and the cabling installation, characterized by the fact that the method includes the step of providing the variable compensation force by lengthening or shortening a path for the one or more of the alternating S/Z twist plied yarns between the one or more twist plying installations and the cabling installation.

14. Method according to claim 10, characterized by the fact that the cabled yarn or the connected yarn is pulled with a pulling force and/or at a pulling speed in which the pulling force and/or the pulling speed is adjusted, taking into account a longitudinal change of the twist plied yarn between the twist plying installation and the cabling installation.

15. Method for the manufacturing of an alternating S/Z cabled yarn or a connected alternating S/Z twist plied yarn according to claim 10, in which the incoming yarns are plied by:

i twisting the at least two incoming yarns;

ii consequently gathering the twisted yarns and iii entangling the gathered twisted yarns into plying nodes;

and that the twist plied yarns are cabled by:

iv twisting the at least two plied yarns;

v consequently gathering the twist plied yarns and vi entangling the gathered plied yarns into cabling nodes;

characterized by the fact that the plying nodes are tracked virtually and that in step iv the at least two plied yarns are twisted in which the cabling nodes coincide with plying nodes of at least one of the at least two twist plied yarns and that in step vi the twist plied yarns are entangled at the plying nodes so that the cabling nodes are tangled with the plying nodes of at least one of the at least two plied yarns.

* * * * *